US008601953B2

(12) United States Patent
Hachet et al.

(10) Patent No.: US 8,601,953 B2
(45) Date of Patent: Dec. 10, 2013

(54) RAILWAY VEHICLE WITH MOVABLE PLATFORMS AND RUNNING BOARDS

(75) Inventors: Joël Hachet, Clavette (FR); Michel Cherdo, Lagord (FR)

(73) Assignee: Alstom Transport SA, Levallois-Perret (FR)

( * ) Notice: Subject to any disclaimer, the term of this patent is extended or adjusted under 35 U.S.C. 154(b) by 378 days.

(21) Appl. No.: 12/383,026

(22) Filed: Mar. 19, 2009

(65) Prior Publication Data

US 2010/0043669 A1 Feb. 25, 2010

(30) Foreign Application Priority Data

Mar. 20, 2008 (FR) ..... 08 51802

(51) Int. Cl.
*B61D 47/00* (2006.01)

(52) U.S. Cl.
USPC ..... 105/436

(58) Field of Classification Search
USPC ..... 105/425–427, 432–436
See application file for complete search history.

(56) References Cited

U.S. PATENT DOCUMENTS

| | | | | |
|---|---|---|---|---|
| 5,230,288 | A * | 7/1993 | Bickel | 105/425 |
| 5,316,432 | A | 5/1994 | Smalley et al. | 414/540 |
| 6,599,080 | B1 * | 7/2003 | Karlsson | 414/663 |

FOREIGN PATENT DOCUMENTS

| | | | |
|---|---|---|---|
| DE | 94 01 755 | U1 | 3/1994 |
| DE | 199 14 965 | A1 | 10/2000 |
| DE | 101 13 074 | A1 | 9/2002 |
| EP | 2103498 | A1 | 9/2009 |
| WO | WO 99/48458 | A | 9/1999 |
| WO | WO 02/079018 | | 10/2002 |

OTHER PUBLICATIONS

European Search Report for corresponding EP Patent Application No. 09155379 completed on Apr. 3, 2009.
Translation of European Search report for corresponding EP Patent Application No. 09155379 completed on Apr. 3, 2009.

* cited by examiner

*Primary Examiner* — Robert J. McCarry, Jr.
(74) *Attorney, Agent, or Firm* — Davidson, Davidson & Kappel, LLC

(57) ABSTRACT

This invention relates to a railway vehicle car of the type including a floor including at least one movable platform and a standard platform, the movable platform being located opposite a door in the railway vehicle, the movable platform being capable of moving linearly vertically so that the height of the movable platform can be varied to match the height of the said platform to the height of a station platform, at least one first running board which can move linearly vertically and in a transverse direction being provided to fill the gap between the movable platform and the station platform when the said running board is in a deployed position. The movable platform and the running board can move independently of each other.

9 Claims, 3 Drawing Sheets

RAILWAY VEHICLE WITH MOVABLE PLATFORMS AND RUNNING BOARDS

This claims the benefits of French Patent Application No. 08 51802 filed Mar. 20, 2008 and hereby incorporated by reference herein.

BACKGROUND OF THE INVENTION

This invention relates to a railway vehicle of the type including a floor including at least one movable platform and a standard platform, the movable platform located opposite a door of the railway vehicle, the movable platform being capable of moving linearly vertically so that the height of the movable platform can be varied to match the height of the said platform to the height of a station platform, at least one first running board which can move linearly vertically and transversely being provided to fill the gap between the movable platform and the station platform when the said running board is in a deployed position.

Some railway vehicles are designed to provide access for and accommodate passengers having reduced mobility, who move for example by means of a wheelchair.

In such vehicles provision is generally made for lowering the height of the floor of the area opposite a door of the vehicle in order to approach the height of the station platform and thus prevent there being high steps rendering access to the railway vehicle difficult, in particular for wheelchairs.

In order to fill the gap between the lowered platform and a station platform a running board is provided which moves vertically with the platform and laterally towards the station platform. Thus a passenger with reduced mobility can get on or off the railway vehicle easily without having to negotiate an obstacle such as a step.

However the platform and the running board are generally only operated when a passenger with reduced mobility, a buggy or a goods trolley, has to get on or off the vehicle. For other passengers the platform remains immovable and passengers pass over the difference in height between the platform and the station platform without assistance. It may be that this difference in height is too much for some passengers who then have difficulty in getting on or off the vehicle.

In some cases, if the difference in height between the floor of the vehicle and the height of the station platform is too great, the running board is brought to the height of the platform. As the running board moves with the platform, the entire platform has to be lowered in order to place the running board at the required height, which is not very practical, all the more so as a step is created between the lowered platform and the rest of the structure of the floor of the railway vehicle, which hinders movement of passengers within the railway vehicle.

SUMMARY OF THE INVENTION

The invention is designed to overcome these disadvantages by providing a railway vehicle of the aforesaid type which facilitates access to the vehicle for both passengers with reduced mobility and other passengers without the need for major movements of the platform.

It is an object of the present invention to provide a railway vehicle of the aforesaid type in which the movable platform and running board can move independently of each other.

According to other features of the railway vehicle:

the car of the railway vehicle includes means for remote control of the linear movement of the movable platform and running board so that it can be used by a passenger in the railway vehicle, the car of the railway vehicle includes at least one pneumatic cushion extending beneath the movable platform and a pneumatic cushion extending beneath the running board, the said cushions resting on the chassis of the body of the railway vehicle and deploying and retracting to move the movable platform and/or running board respectively upwards and downwards, the car of the railway vehicle includes a second running board which can move linearly, the two running boards being located on either side of the movable platform in the transverse direction, movement of the first running board, movement of the second running board and movement of the movable platform are controlled independently of each other, the movable platform is aligned with the standard platform when the railway vehicle is in movement and can move towards a floor height which is lower than that of the standard platform when the railway vehicle is at a station platform, the height of the floor of the movable platform varies between substantially 500 mm and 1200 mm in relation to the rails on which the railway vehicle is intended to run, and the height of the floor of the running board can be varied between substantially 500 mm and 800 mm in relation to the rails on which the railway vehicle is intended to run.

BRIEF DESCRIPTION OF THE DRAWINGS

Other features and advantages of the invention will be apparent from a reading of the following description provided by way of example with reference to the appended drawings in which:

FIGS. 2 to 5 are diagrammatical illustrations in transverse cross-section of the access zone to a railway vehicle car according to the invention, in different operating positions, in which:

FIG. 2 shows the state of a door open on the station platform side, for a high station platform, in which the access provisions for persons of reduced mobility are not operated, FIG. 3 illustrates the state of a door open on the station platform side, for a high platform, in which the access provisions for persons of reduced mobility are operated, FIG. 4 illustrates the state of a door open on the station platform side, for a low platform, in which the access provisions for persons of reduced mobility are not operated, FIG. 5 illustrates the state of a door open on the station platform side, for a low platform, in which the access provisions for persons of reduced mobility are operated.

DETAILED DESCRIPTION

In the description the term height is defined in relation to the rails on which a railway vehicle is intended to run and in a substantially vertical direction when the vehicle stands on the rails. Furthermore the terms "longitudinal" and "transverse" are defined according to the length and width of the railway vehicle respectively.

Figure 1:
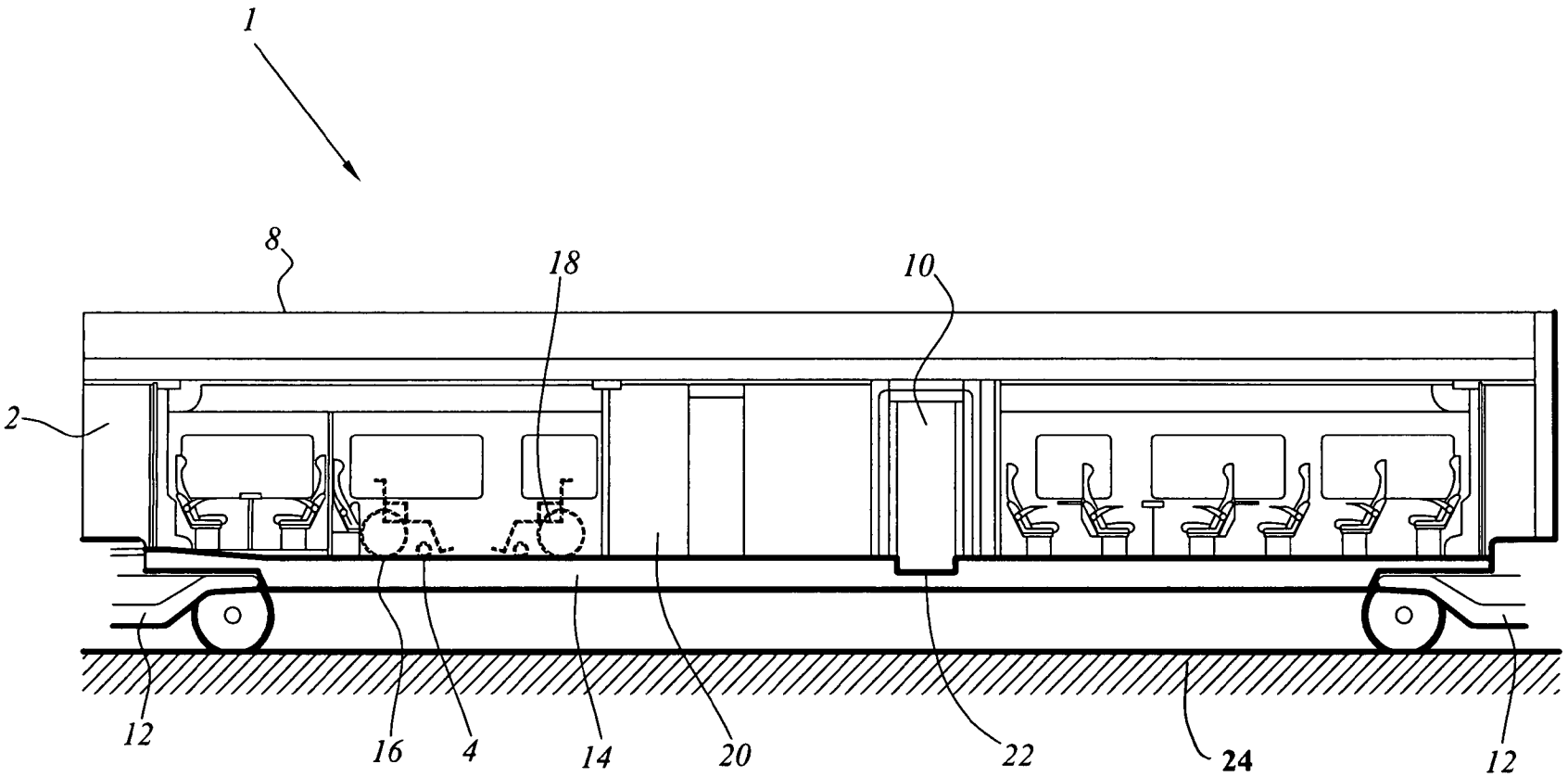
FIG. 1 is a diagrammatical illustration in longitudinal cross-section of a car of a railway vehicle according to the invention.
Figure 2:
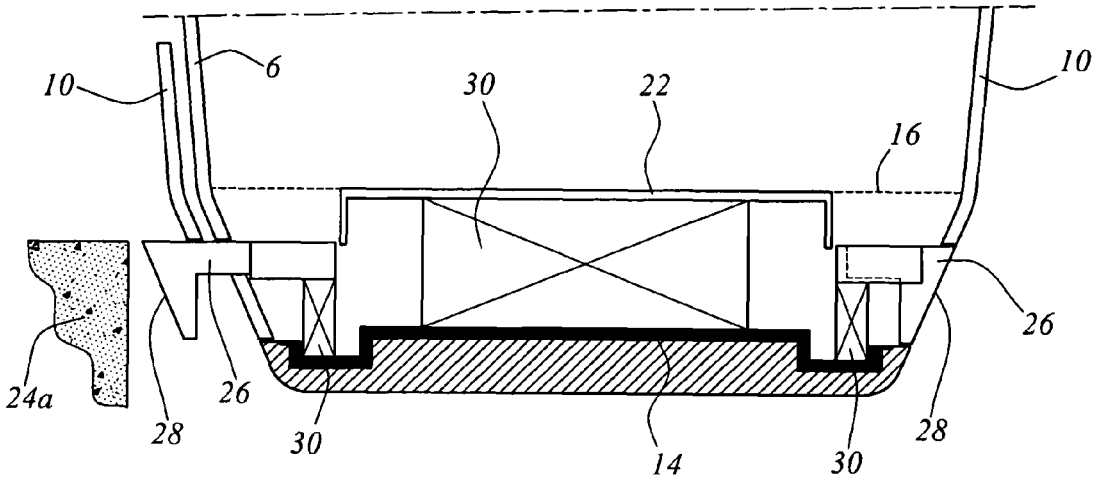

With reference to FIGS. 1 and 2, these show a railway vehicle 1 including a body 2 formed of a floor 4, side walls and a roof 8. Body 2 includes at least one door 10 providing access to the interior of railway vehicle car 1. In the embodiment shown, door 10 is located substantially at the centre of each side wall of body 2. The longitudinal position of the door on the wall is however immaterial as far as application of the proposed invention is concerned.

The vehicle is supported in a conventional way on two bogies 12 provided at each end part of body 2. Floor 4 includes at least one standard platform 16 which is substantially flat. By standard is meant a platform in which the floor height is conventional for a railway vehicle. The floor height of a standard platform is included for example substantially between 1000 mm and 1200 mm with respect to the rails on which railway vehicle 1 is intended to run.

According to one possible embodiment, standard platform 16 includes an area including a plurality of seats to accommodate passengers along one side wall and an area without seats to accommodate wheelchairs 18 for passengers with reduced mobility along the other side wall opposite the said area.

Figure 3:
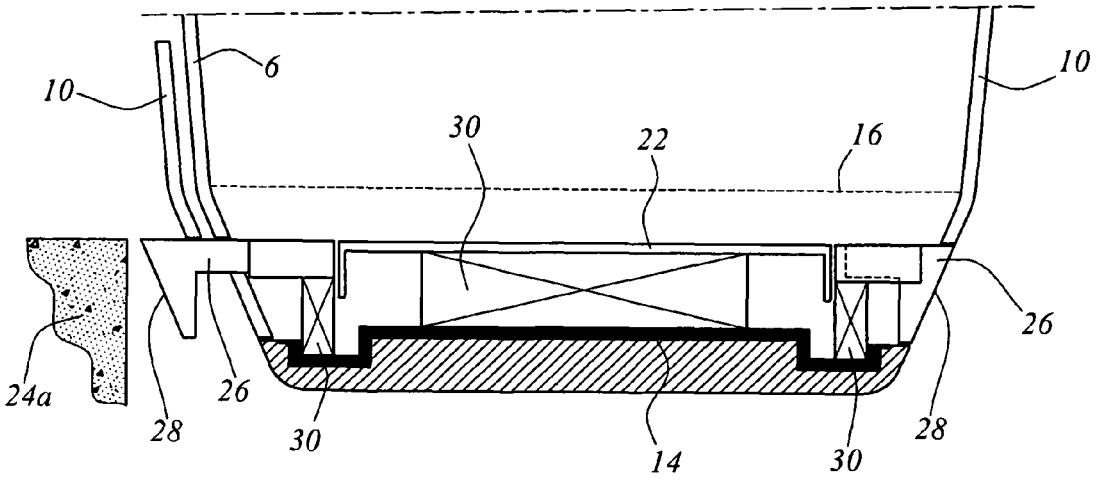
Figure 4:
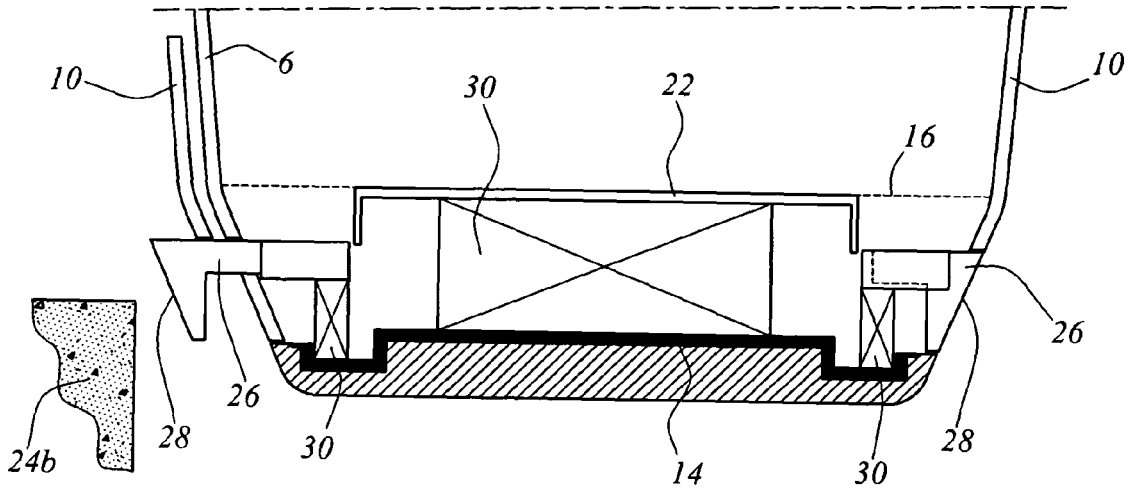
Figure 5:
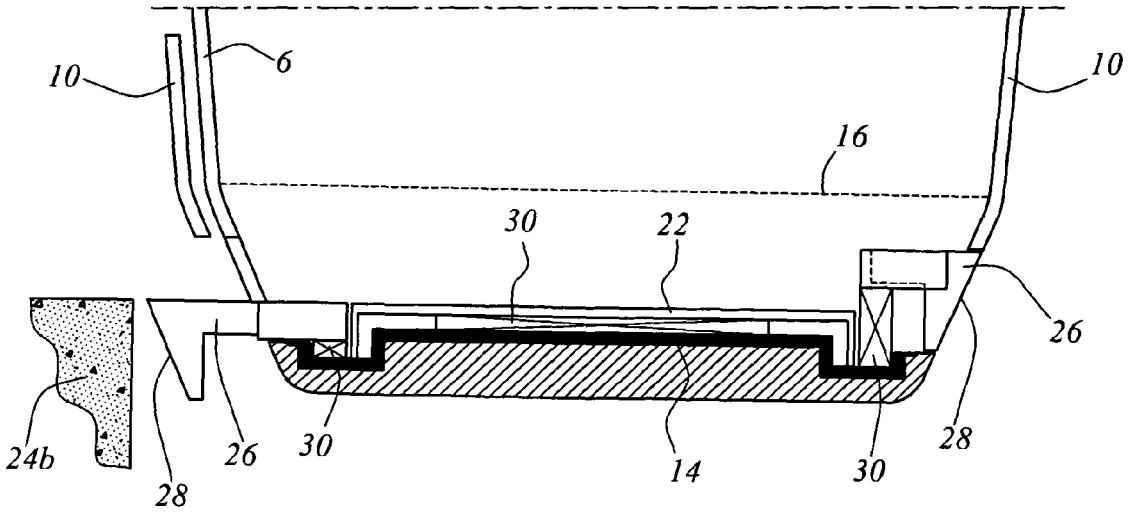

Floor 4 also includes at least one movable platform 22 located opposite doors 10 of vehicle 1. Platform 22 can move vertically in relation to standard platform 16 in such a way that it can be adjusted to the height of a station platform 24, the height of which may vary depending upon the stations where the train stops. In FIGS. 2 to 5 two different platform heights are shown by way of illustration:

a high platform 24*a*, having a height of for example 760 mm (FIGS. 2 and 3), a low platform 24*b*, having a height of for example 550 mm (FIGS. 4 and 5).

When the railway vehicle is in motion, movable platform 22 of the vehicle is located substantially at the same floor height as the adjacent standard platform, that is to say at a height comprised substantially between 1000 mm and 1200 mm. As a result passengers can move around in the car on a floor which is substantially flat and without any obstacles of the step type, which in particular eases the movement of passengers having reduced mobility. If differences in the height of the floor are necessary, for example in order to pass above bogies, the different floor heights are connected together by means of slopes. Characteristics such as the length and the steepness of the slopes are defined in accordance with standards so that the slopes are not too steep for passengers. These slopes are for example comprised between 6% and 8%.

When the railway vehicle stops at a station platform, movable platform 22 can move so as to descend beneath the level of the floor of standard platform 16 so that it can be located at a height which is substantially the same as that of station platform 24. Such a station platform may have different heights depending upon the station of which the train stops. FIGS. 2 and 3 show a high station platform 24*a*, of height substantially equal to 760 mm, and FIGS. 4 and 5 show a low station platform 24*b*, of height substantially equal to 550 mm. Thus movable platform 22 can be moved to a height which is substantially the same as approximately 550 mm in order to match the different heights of station platforms 24. Thus the height of movable platform 22 can be adjusted to the height of station platform 24 at the station at which the train stops, enabling passengers having reduced mobility to get on or off the railway vehicle without making use of an external ramp.

In order to fill the transverse gap between movable platform 22 and station platform 24 the railway vehicle also includes a running board 26 which can move vertically and transversely. Running board 26 can move between a retracted position and a plurality of deployed positions suitable for different situations as described below.

According to the embodiment illustrated in FIGS. 2 to 5, the railway vehicle includes two running boards 26 located on either side of movable platform 22 in the transverse direction.

In the retracted position running boards 26 extend within the car at the sides of movable platform 22, as shown by the running board on the side opposite the station platform, and therefore not operated, on the right-hand side in FIGS. 2 to 5. When the railway vehicle is in motion movable platform 22 is raised to the same height as standard platform 16 so as not to obstruct the movement of passengers from one end of the car to the other and running boards 26 extend at a lower height between movable platform 22 and door 10, giving rise to a step height consistent with the rules governing ergonomics of access. According to the embodiment illustrated in FIGS. 2 to 5, running board 26 includes at its free end a downward projection 28 which extends vertically as an extension of door 10 in the retracted position. Projection 28 ensures aesthetic and technical continuity between the bottom of door 10 and the chassis of body 14. As far as technical continuity is concerned, projection 28 is in fact provided with a peripheral sealing system which protects the passenger space from the noise and pressure waves which form when the railway vehicle runs at high speed.

According to an embodiment which is not shown, running board 26 is substantially flat and is located completely within the vehicle in a retracted position.

As mentioned previously, running boards 26 can be moved into a plurality of deployed positions to fill the transverse gap between movable platform 22 and station platform 24 so that passengers can get on and off railway vehicle 1 more easily. Running boards 26 move vertically and transversely. The movements of the two running boards 26 and movable platform 22 are controlled independently of each other.

Transverse movement of a running board 26 is arranged so that the extremity of the running board is positioned substantially alongside the edge of station platform 24 and substantially against the edge of station platform 24 so that there is substantially no open gap in the transverse direction between station platform 24 and running board 26, as shown on the left-hand side of FIGS. 2 to 5.

Vertical movement of running boards 26 allows running boards 26 to be positioned in relation to the height of the station platform at which the railway vehicle has stopped. Several situations may be envisaged.

In the retracted position the running board is for example located at a height of substantially 760 mm so that it can optimally serve high station platforms 24*a*.

In the case of a high station platform 24*a*, for example of a height of substantially 760 mm, running board 26 is only moved in the transverse direction against station platform 24*a* (FIGS. 2 and 3). If no passenger with reduced mobility using a wheelchair or any other wheeled items such as buggies or trolleys have to get on or off the train, movable platform 22 is not moved and remains at the same height as standard platform 16, as illustrated in FIG. 2. Passengers getting on and off merely step onto the step formed between running board 26 and movable platform 22. If a passenger with reduced mobility has to get on or get off the train, movable platform 22 is lowered so that it is at the same height as running board 26, as shown in FIG. 3, and the passenger with reduced mobility can get on or off without having to negotiate any height obstacle.

In the case of a low station platform 24*b*, for example of height substantially 550 mm, running board 26 may be lowered so as to be at a height substantially identical to that of the station platform or may be moved only in the transverse direction, as in the situations illustrated. Thus as shown in FIG. 4, if no passenger with reduced mobility using a wheelchair or other wheeled items such as buggies or trolleys have to get on or off the train, running board 26 is moved only in the transverse direction so that it is substantially alongside the edge of the station platform and forms a step between station platform 24*b* and running board 26. Movable platform 22 is not moved and remains at the same height as standard platform 16. Passengers then simply step up or down the step formed between running board 26 and movable platform 22 and the step formed between running board 26 and station platform 24*b*. The height of the steps is for example 200 mm or less in order to comply with the rules specifying ergonomics of access to the vehicle. If a passenger with reduced mobility has to get on or off the train, running board 26 and movable platform 22 are lowered so that they are at the same height as station platform 24*b*, as illustrated in FIG. 5, and the passenger with reduced mobility can get on or get off without having to negotiate any height obstacle.

An ordinary platform height of 950 mm can be used to serve the 2 standard station platform heights, namely 550 mm and 760 mm, with step heights of the order of 200 mm, consistently with the rules specifying ergonomics of access.

It will be understood that only one running board 26 will be moved if the vehicle is stopped at a station platform on one side of the vehicle or that two running boards may be moved if there are two station platforms on either side of the railway vehicle respectively, the movement of each running board being independent of the other.

Vertical movements of running boards 26 and movable platform 22 are for example brought about by means of pneumatic cushions 30 extending beneath each running board 26 and movable platform 22 respectively. Cushions 30 rest on the chassis of body 14. They then deploy for upward movement of movable platform 22 and/or running board 26 and retract for downward movements of movable platform 22 and/or running board 26.

The movements of running boards 26 and movable platform 22 are for example automatically controlled by the automatic systems on board the vehicle according to the height of the station platform served and in a generally-applicable way, i.e. without making provision for access for passengers with reduced mobility. However, in the case where a passenger with reduced mobility has to get on or off the railway vehicle a remote control device of the remote control type is provided to him at the station before he boards the train. This remote control device can be used to control the automatic systems on board the vehicle to bring about a secure movement of running boards 26 and movable platform 22. Thus passengers with reduced mobility can themselves activate movement of movable platform 22 and running boards 26 and get on or get off the train without any involvement by train or station staff.

The invention described above thus makes it possible to ease access to the railway vehicle for passengers having reduced mobility without the need for action by train or station staff. Furthermore, as movement of movable platform 22 is independent of movement of running boards 26 there is no need to activate movement of the whole if no passenger with reduced mobility has to board the railway vehicle, as a result of which movements of movable platform 22 can be reduced to a minimum. Likewise movements of the running boards can be reduced to a minimum if they are not required to move vertically. When there is no need for movable platform 22 to move, the creation of a step between the movable platform and the standard platform is avoided, easing the movements of passengers within the railway vehicle.

The description has been provided with reference to passengers moving through use of a wheelchair. It will however be understood that that invention is also particularly advantageous for other wheeled items, such as buggies, trolleys, etc.

The invention claimed is:

1. A railway vehicle car comprising:

a floor including at least one movable platform and a vehicle platform, the movable platform being located opposite a door in the railway vehicle, the movable platform being movable vertically so that a height of the movable platform is variable to match a height of a station platform; and at least a first running board movable between a retracted position and a plurality of deployed positions, the first running board movement including a first transversal movement between the retracted position and a first deployed position, and a second vertical movement between the first deployed position and the further deployed positions, the first running board filling the gap between the movable platform and the station platform when the running board is in one of the deployed positions, the vertical movement of the movable platform and the second vertical movement of the running board being independent of each other.

2. The railway vehicle car according to claim 1, further comprising means for remote control of the movement of the movable platform and running board so that the movable platform and running board can be used by a passenger in the railway vehicle.

3. The railway vehicle car according to claim 1, further comprising at least one pneumatic cushion extending beneath the movable platform and one pneumatic cushion extending beneath the running board, the cushions resting on a chassis of the body of the railway vehicle and deploying and retracting in order to move the moving platform and/or the running board up and down respectively.

4. The railway vehicle car according to claim 1, further comprising a second running board that is separately movable in the transversal and vertical directions, the first and second running boards being located on either side of the movable platform in the transverse direction.

5. The railway vehicle car according to claim 4, wherein movement of the first running board, movement of the second running board and movement of the movable platform are controlled independently of each other.

6. The railway vehicle car according claim 1, wherein the movable platform is aligned with the vehicle platform when the railway vehicle is in motion and moves to a floor height which is lower than that of the vehicle platform when the railway vehicle is in a station.

7. The railway vehicle car according to claim 1, wherein the height of the floor of the movable platform is variable between substantially 500 mm and 1200 mm in relation to the rails on which the railway vehicle is to run.

8. The railway vehicle according claim 1, wherein the height of the floor of the running board is variable between substantially 500 mm and 800 mm in relation to the rails on which the railway vehicle is to run.

9. The railway vehicle according to claim 1, wherein the second vertical movement moves the first running board to a height that matches the height of the station platform.

* * * * *